US007032630B1

(12) United States Patent
Grantham

(10) Patent No.: US 7,032,630 B1
(45) Date of Patent: Apr. 25, 2006

(54) CONTROL OF A/L RATIOS IN VACUUM ASSIST VAPOR RECOVERY DISPENSERS

(75) Inventor: Rodger P. Grantham, Springfield, MO (US)

(73) Assignee: Vapor Systems Technologies, Inc., Dayton, OH (US)

( * ) Notice: Subject to any disclaimer, the term of this patent is extended or adjusted under 35 U.S.C. 154(b) by 0 days.

(21) Appl. No.: 10/820,317

(22) Filed: Apr. 8, 2004

Related U.S. Application Data

(60) Provisional application No. 60/461,725, filed on Apr. 10, 2003.

(51) Int. Cl.
*B65B 1/04* (2006.01)

(52) U.S. Cl. ..... 141/59; 141/4; 141/83

(58) Field of Classification Search ..... 141/2, 141/4, 5, 9, 39, 44, 47, 50, 59, 67, 83, 94, 141/95, 192, 285
See application file for complete search history.

(56) References Cited

U.S. PATENT DOCUMENTS

| | | | | |
|---|---|---|---|---|
| 4,566,504 | A | 1/1986 | Furrow et al. | |
| 5,484,000 | A | 1/1996 | Hasselmann | |
| 5,494,409 | A | 2/1996 | Webb et al. | |
| 5,592,979 | A * | 1/1997 | Payne et al. | 141/59 |
| 5,782,275 | A | 7/1998 | Hartsell, Jr. et al. | |
| 5,794,667 | A | 8/1998 | Payne et al. | |
| 5,850,857 | A | 12/1998 | Simpson | |
| 5,857,500 | A | 1/1999 | Payne et al. | |
| 5,860,457 | A | 1/1999 | Andersson | |
| 5,913,343 | A | 6/1999 | Andersson | |
| 5,971,042 | A | 10/1999 | Hartsell, Jr. | |
| 6,082,415 | A | 7/2000 | Rowland et al. | |
| 6,095,204 | A | 8/2000 | Healy | |
| 6,170,539 | B1 | 1/2001 | Pope et al. | |
| 6,179,163 | B1 | 1/2001 | Bohr et al. | |
| 6,197,923 | B1 | 3/2001 | Yamamoto | |
| 6,360,789 | B1 | 3/2002 | Walker et al. | |
| 6,460,579 | B1 * | 10/2002 | Nanaji | 141/59 |
| 6,463,389 | B1 | 10/2002 | Dickson | |
| 6,608,484 | B1 | 8/2003 | Grantham et al. | |
| 6,830,080 | B1 * | 12/2004 | Nanaji | 141/59 |
| 2001/0029997 | A1 | 10/2001 | Walker et al. | |

* cited by examiner

*Primary Examiner*—Timothy L. Maust
(74) *Attorney, Agent, or Firm*—Stevens & Showalter LLP

(57) ABSTRACT

The air-to-liquid (A/L) ratio in vacuum assist vapor recovery dispensers of fueling systems is controlled by utilizing an in-station diagnostics (ISD) system interfaced with the dispenser or a dispenser diagnostics system. Diagnostics systems monitor the performance of the vapor recovery system according to a number of variables. In one embodiment, a diagnostics system is configured to monitor the A/L ratio of each dispensing event using a flow meter placed in the vapor line and a fluid meter placed in the fuel supply line.

12 Claims, 2 Drawing Sheets

CONTROL OF A/L RATIOS IN VACUUM ASSIST VAPOR RECOVERY DISPENSERS

This application claims the benefit of U.S. Provisional Patent Application Ser. No. 60/461,725, filed Apr. 10, 2003 which is hereby incorporated by reference in its entirety.

BACKGROUND OF THE INVENTION

This invention relates generally to dispensing fuel and, more particularly, to a system and associated method for controlling vapor recovery in vacuum assist vapor recovery dispensers.

In fuel dispensing systems, such as those used for delivering gasoline to the fuel tank of a vehicle, environmental protection laws require that vapors emitted from the tank during the fuel dispensing process be recovered. Fuel is customarily delivered through a nozzle via a fuel hose and vapors are recovered from the nozzle via a vapor hose that conveys the vapor to the storage tank from whence the fuel came. In what is referred to as a balanced system, the vapors are forced through the vapor hose by the positive pressure created in the vehicle tank as the fuel enters it.

In other systems, referred to as assist-type systems, the vapor is pumped from the vehicle tank and forced into the storage tank by a vapor recovery system connected to the vapor hose. One example of an assist vapor recovery system is described in U.S. Pat. No. 6,095,204 Issued to Healy and hereby incorporated by reference. Currently, many fuel dispensing pumps at service stations are equipped with vacuum assisted vapor recovery systems that collect fuel vapor vented from the fuel tank filler pipe during the refueling operation and transfer the vapor to the fuel storage tank. Assist type vapor recovery systems use a vapor pump to "assist" in the collection of vapors generated during vehicle refueling.

One criteria of the performance of the fuel dispenser is the ratio of the vapor or air being recovered and returned to the underground storage tank (UST) to the fuel or liquid being pumped from the UST to the vehicle. However, certain variables may affect the valve of the air-to-liquid (A/L) ratio and these variables need to be accounted for to provide a consistent and reliable refueling operation. Typical variables include the pressure drop of the hose and nozzle, the speed of the pump with varying flow rates, meter outputs from grade to grade, pump wear, etc.

Fuel dispensing systems at service stations having vacuum assisted vapor recovery capability which are unable to account for these and other variables waste energy, increase wear and tear, ingest excessive air into the underground storage tank and cause excessive pressure buildup in the piping and UST due to the expanded volume of hydrocarbon saturated air. Such problems could become systematic and present a significant issue that must be addressed.

SUMMARY OF THE INVENTION

These and other problems with known fuel dispensing systems and particularly vacuum assist vapor recovery dispensers have been overcome with this invention.

According to one embodiment of this invention, the air-to-liquid (A/L) ratio in vacuum assist vapor recovery dispensers is controlled by utilizing an in-station diagnostics (ISD) system interfaced with the dispenser or a dispenser diagnostics system. Diagnostics systems monitor the performance of the vapor recovery system according to a number of variables. In one embodiment, a diagnostics system is configured to monitor the A/L ratio of each dispensing event using a flow meter placed in the vapor line and a fluid meter placed in the fuel supply line.

A feedback loop from the vapor flow meter to the vapor pump enables a more precise control of the A/L ratio. The actual A/L ratio being measured by the diagnostics system is used to trim the A/L ratio to the desired setting. This eliminates the impact of the variables mentioned earlier in deteriorating the performance of the vapor recovery system.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

DETAILED DESCRIPTION OF THE INVENTION

Figure 1:
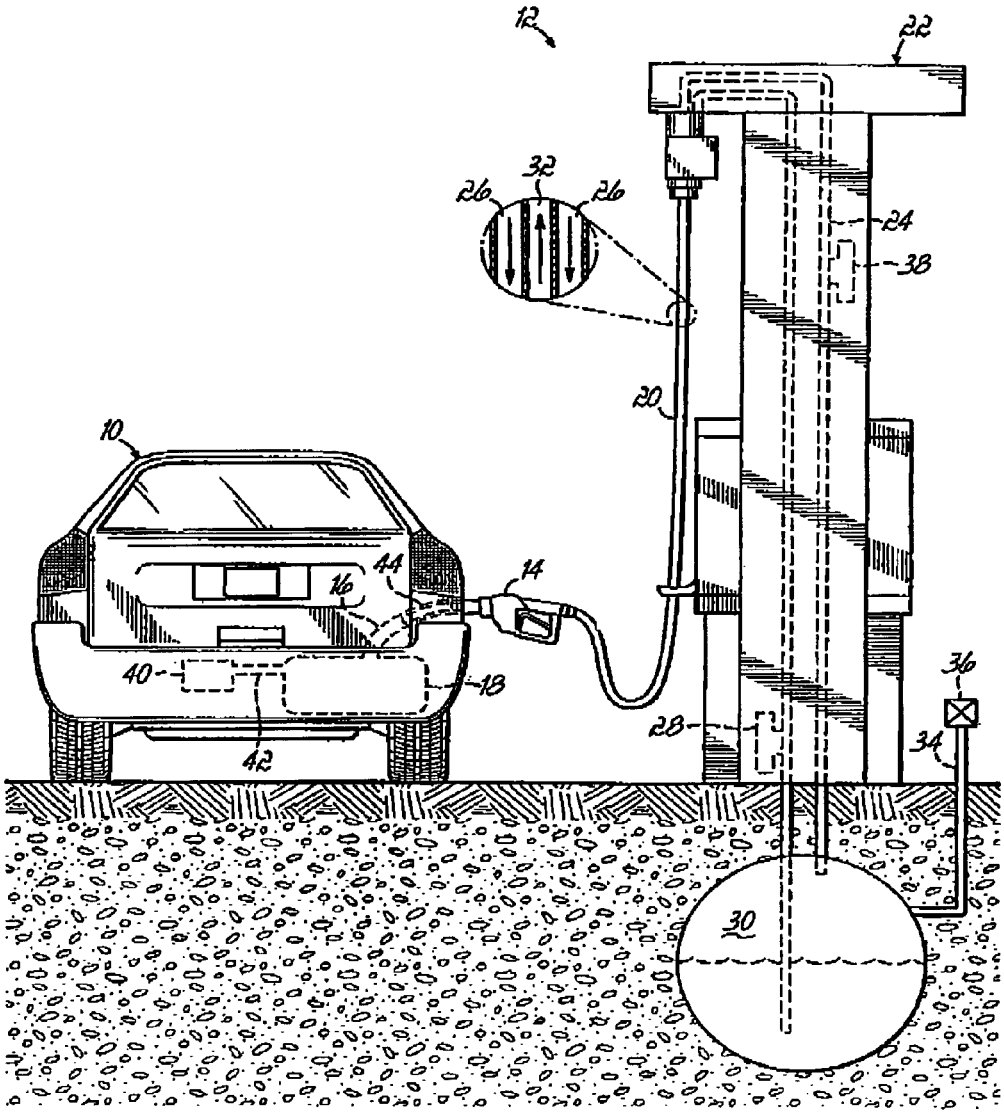
FIG. 1 is an exemplary refueling system for a vehicle according to an embodiment of this invention.

Referring to FIG. 1, a vehicle 10 is shown being refueled with a refueling system 12. A nozzle 14 is inserted into a filler pipe 16 of a fuel tank 18 of the vehicle 10 during the refueling operation.

A fuel delivery hose 20 is connected to the nozzle 14 on one end and to a refueling system dispenser 22 on the opposite end. The refueling system 12 includes an assist-type vapor recovery system 24. As shown by the cut-away view of the interior of the fuel delivery hose 20, an annular fuel delivery passageway 26 is formed within the fuel delivery hose 20 for delivering fuel by a pump 28 from an underground storage tank (UST) 30 to the nozzle 14. A central, tubular vapor passage 32 as part of the vapor recovery system 24 is also within the fuel delivery hose 20 for transferring fuel vapors expelled from the vehicle's tank 18 to the UST 30 during the refueling of the vehicle 10. The fuel delivery hose 20 is depicted as having the internal vapor passage 32 with the fuel delivery passage 26 concentrically surrounding it.

As shown in FIG. 1, the UST 30 includes a vent pipe 34 and a pressure vent valve 36 for venting the UST 30 to the atmosphere. The valve 36 vents the UST 30 to air at about +3.0 inches $H_2O$ or −8.0 inches $H_2O$.

A vapor recovery pump 38 provides a vacuum in the vapor passage 32 for removing fuel vapor during a refueling operation. The vapor recovery pump 38 may be placed anywhere along the vapor recovery system 24 at or between the nozzle 14 and the UST 30. Vapor recovery systems utilizing vapor recovery pumps of the type shown and described herein are well known in the industry and are commonly utilized for recovering vapor during refueling of vehicles which are not equipped with on-board refueling vapor recovery (ORVR) systems. A vehicle being refueled may include an ORVR system 40, for example as shown in the vehicle 10 of FIG. 1.

The vehicle fuel tank of an ORVR equipped vehicle typically has an associated on-board vapor recovery system. These exemplary ORVR system 40 shown in FIG. 1 has a vapor recovery inlet 42 extending into the fuel tank 18. As the fuel tank 18 fills, pressure within the tank 18 increases and forces vapors into the ORVR system 40 through the vapor recovery inlet 42. The ORVR system 40 also may use a check valve (not shown) along the filler pipe 16 to prevent further loss of vapors. One mechanism that may be included in the refueling system dispenser 22 of this invention to enable the vapor recovery system 24 to accommodate the ORVR system 40 is disclosed in U.S. Pat. No. 6,810,922 which is incorporated herein by reference in its entirety.

As liquid fuel rushes into the fuel tank 18 during the refueling operation, fuel vapors are forced out of the fuel tank 18 through a spout 44 of the nozzle 14. The vapor recovery system 24 pulls the fuel vapors through the hose 20 along the vapor passage 32 and ultimately into the UST 30. This is the standard operation when refueling vehicles not equipped with ORVR systems.

Figure 2:
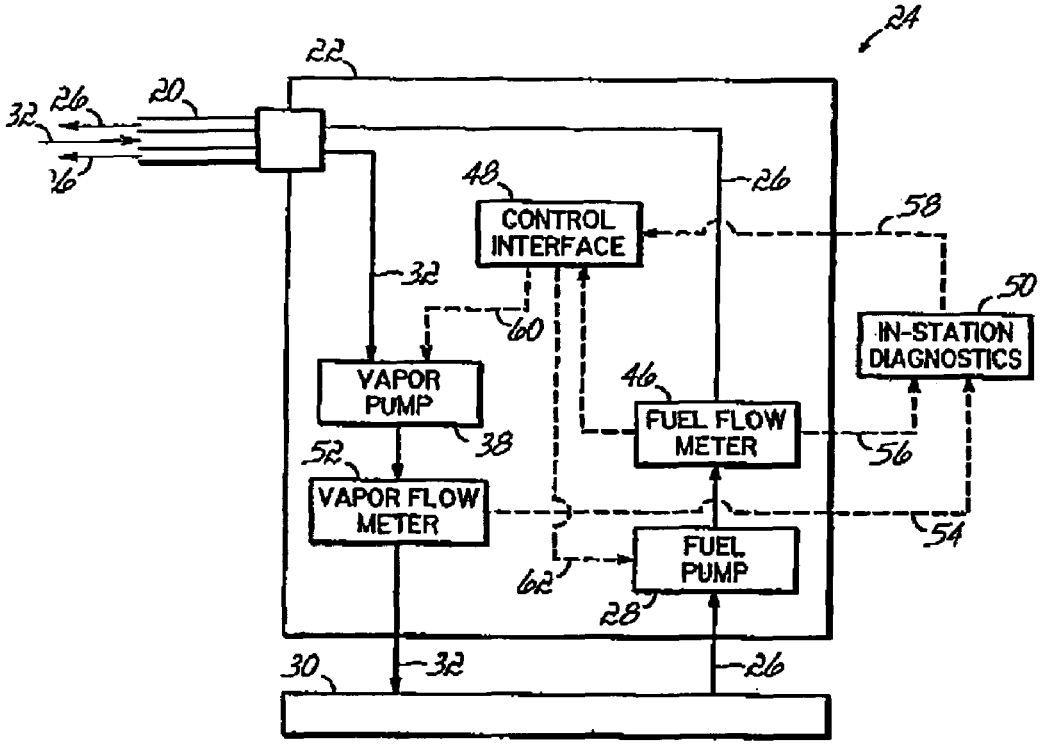
FIGS. 2 and 3 are schematic illustrations of a vacuum assist vapor recovery dispenser interfaced with an in-station diagnostic system according to embodiments of this invention.
Figure 3:
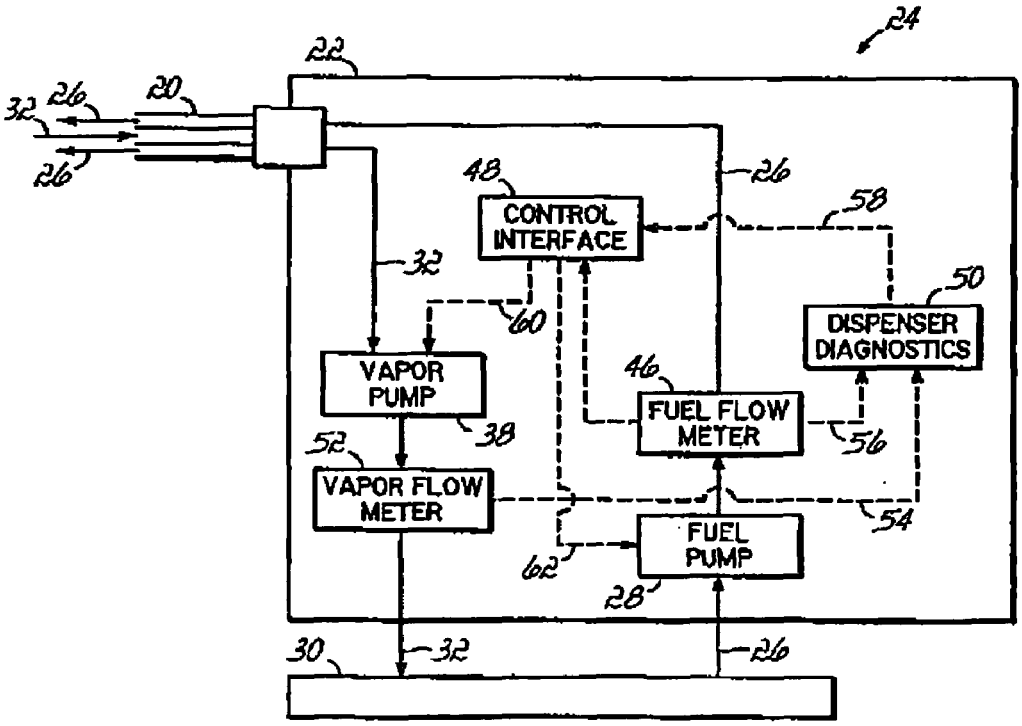

According to this invention and as shown in FIGS. 2 and 3, assist-type vapor recovery systems 24 use the vapor pump 38 to "assist" in the collection of vapors generated during vehicle refueling. The speed of the vapor pump 38 or rate at which the vapors/air are pulled from the fuel tank 18 may be correlated to an output of a liquid meter, a fuel flow meter 46 as illustrated, measuring the rate of fuel being pumped by the dispenser 22 to the fuel tank 18. An electronic control interface 48, connected between the meter output 46 and the speed control of the vapor pump 38, allows the ratio of vapor/air flow to fuel/liquid flow (A/L ratio) to be adjusted to the desired level. Once this level setting is adjusted, it may be established as a fixed value, which in one embodiment is preferably about 1.0 (i.e., A/L=1.0). In many cases, an A/L ratio in the range of 0.95/1.0 to 1.05/1.0 is targeted because precision is often difficult to achieve, especially as the components of the system wear.

Certain variables may affect the value of the air-to-liquid (A/L) ratio and these variables need to be accounted for. Typical variables include the pressure drop of the hose 20 and nozzle 14, the speed and/or efficiency of the pump 38 with varying flow rates, meter outputs from grade to grade, pump wear, etc.

According to this invention, a diagnostics agent 50 is introduced for controlling the A/L ratio in vacuum assist vapor recovery refueling system dispensers 22 by utilizing an in-station diagnostics (ISD) system 50*a* remote from the dispenser 22 but interfaced with the dispenser 22 (FIG. 2) or a dispenser diagnostics system 50*b* located with the dispenser 22 (FIG. 3). Diagnostics agent 50 monitors the performance of the vapor recovery system 24 according to a number of variables. For example, the diagnostics agent 50 may be configured to monitor the A/L ratio of each dispensing event using a vapor flow meter 52 placed in the vapor line 32 and the flow meter 46 placed in the fuel supply line 26.

A The control interface 48 in communication with the diagnostics agent 50 enables more precise control of the A/L ratio. Specifically, in one embodiment, the diagnostics agent 50 is in communication with the vapor flow meter 52 via a loop 54 and in communication with the fuel flow meter 46 via a loop 56. A feedback loop 58 from the diagnostics agent 50 through the control interface 48 is provided via a feedback loop 60 to the vapor pump 38 and via a feedback loop 62 to the fuel pump 28. The feedback loops to one or both of the pumps 28, 38 based on the respective flow rates measured by the flow meters 46, 52 enables a more precise control of the A/L ratio.

Preferably, one or both of the flow rates are adjusted to achieve an A/L ratio of about 1.0. The actual A/L ratio being measured by the diagnostics agent 50 would be used to trim the A/L ratio to the desired setting. This would eliminate the impact of the variables mentioned earlier in deteriorating the performance of the vapor recovery system 24.

The retrofit of an existing fuel system 12 to accomplish such an improvement is a simple matter of hanging a new nozzle and valve assemble in the fuel system. It should be appreciated by those of ordinary skill in the art that the retrofit of existing fuel systems is easily accomplished with the implementation and installation of an assembly as described herein. Additionally, the installation of new fuel systems preferably includes an assembly according to this invention.

From the above disclosure of the general principles of the present invention and the preceding detailed description of at least one preferred embodiment, those skilled in the art will readily comprehend the various modifications to which this invention is susceptible. Therefore, I desire to be limited only by the scope of the following claims and equivalents thereof.

I claim:

1. A fueling system for a vehicle comprising:

a fuel storage tank for containing liquid fuel and an ullage space;

a fuel pump for pumping the liquid fuel from the storage tank to a fuel tank of the vehicle;

a nozzle assembly coupled to a hose for delivering the fuel being pumped from the storage tank to the fuel tank;

a vapor pump coupled to the hose and in communication with the nozzle for extracting vapor displaced from the fuel tank and delivering the vapor to the ullage space of the fuel storage tank;

a vapor flow meter in communication with the vapor pump for measuring a flow rate of the vapor;

a fuel flow meter in communication with the fuel pump for measuring a flow rate of the fuel;

a diagnostic agent in communication with the vapor flow meter and the fuel flow meter to generate a ratio of the flow rate of the vapor to the flow rate of the fuel; and a control interface in communication with the diagnostic agent and at least one of the fuel pump and the vapor pump to provide a feedback signal to the at least one pump to adjust the flow through the at least one pump based on the ratio of the vapor and fuel flow rates.

2. The fueling system of claim 1 further comprising:

a fuel dispenser assembly coupled in fluid communication with the fuel storage tank and the nozzle via the hose.

3. The fueling system of claim 2 wherein the diagnostic controller is contained in the fuel dispenser assembly.

4. The fueling system of claim 2 wherein the diagnostic controller is remote from the fuel dispenser assembly.

5. The fueling system of claim 1 wherein the flow rate of the at least one pump is adjusted so that the ratio of the vapor flow rate to the fuel flow rate is about 1.0.

6. A dispenser assembly for pumping fuel from a fuel storage tank through a hose and out of a nozzle into a vehicle fuel tank, the dispenser assembly comprising:

a fuel pump adapted to pump the liquid fuel from the storage tank to the vehicle fuel tank;

a vapor pump adapted to be coupled to the nozzle for extracting vapor displaced from the fuel tank and delivering the vapor to an ullage space of the fuel storage tank;

a vapor flow meter adapted to be in communication with the vapor pump for measuring a flow rate of the vapor;

a fuel flow meter adapted to be in communication with the fuel pump for measuring a flow rate of the fuel;

a diagnostic agent in communication with the vapor flow meter and the fuel flow meter to generate a ratio of the flow rate of the vapor to the flow rate of the fuel; and a control interface in communication with the diagnostic agent and at least one of the fuel pump and the vapor pump to provide a feedback signal to the at least one pump to adjust the flow through the at least one pump based on the ratio of the vapor and fuel flow rates.

7. The dispenser assembly of claim 6 wherein the diagnostic agent is contained in the dispenser assembly.

8. The dispenser assembly of claim 6 wherein the diagnostic agent is remote from the dispenser assembly.

9. The dispenser assembly of claim 6 wherein the flow rate of the at least one pump is adjusted so that the ratio of the vapor flow rate to the fuel flow rate is about 1.0.

10. A method of dispensing fuel from a fuel storage tank through a hose and out of a nozzle into a vehicle fuel tank, the method comprising the steps of:

pumping fuel from the storage tank through the hose and out of the nozzle into the vehicle fuel tank;

measuring a flow rate of the fuel being pumped;

pumping vapor from the vehicle fuel tank through the hose and into the fuel storage tank;

measuring a flow rate of the vapor being pumped;

calculating a ratio of the vapor flow rate to the fuel flow rate; and adjusting both the flow rate of the fuel and the flow rate of the vapor based on the ratio of the vapor and fuel flow rates to obtain a desired ratio.

11. A fueling system for a vehicle comprising:

a fuel storage tank for containing liquid fuel and an ullage space;

a fuel pump for pumping the liquid fuel from the storage tank to a fuel tank of the vehicle;

a nozzle assembly coupled to a hose for delivering the fuel being pumped from the storage tank to the fuel tank;

a vapor pump coupled to the hose and in communication with the nozzle for extracting vapor displaced from the fuel tank and delivering the vapor to the ullage space of the fuel storage tank;

a vapor flow meter in communication with the vapor pump for measuring a flow rate of the vapor;

a fuel flow meter in communication with the fuel pump for measuring a flow rate of the fuel;

a diagnostic agent in communication with the vapor flow meter and the fuel flow meter to generate a ratio of the flow rate of the vapor to the flow rate of the fuel; and a control interface in communication with the diagnostic agent and both the fuel and vapor pumps to provide a feedback signal to the fuel and vapor pumps to adjust the flow through the fuel and vapor pumps based on the ratio of the vapor and fuel flow rates.

12. A dispenser assembly for pumping fuel from a fuel storage tank through a hose and out of a nozzle into a vehicle fuel tank, the dispenser assembly comprising:

a fuel pump adapted to pump the liquid fuel from the storage tank to the vehicle fuel tank;

a vapor pump adapted to be coupled to the nozzle for extracting vapor displaced from the fuel tank and delivering the vapor to an ullage space of the fuel storage tank;

a vapor flow meter adapted to be in communication with the vapor pump for measuring a flow rate of the vapor;

a fuel flow meter adapted to be in communication with the fuel pump for measuring a flow rate of the fuel; and a diagnostic agent in communication with the vapor flow meter and the fuel flow meter to generate a ratio of the flow rate of the vapor to the flow rate of the fuel a control interface in communication with the diagnostic agent and both the fuel and vapor pumps to provide a feedback signal to the fuel and vapor pumps to adjust the flow through the fuel and vapor pumps based on the ratio of the vapor and fuel flow rates.

* * * * *